US007654182B2

(12) United States Patent
Kawai

(10) Patent No.: US 7,654,182 B2
(45) Date of Patent: Feb. 2, 2010

(54) COATED SHEET CUTTING METHOD AND APPARATUS

(75) Inventor: Hirokazu Kawai, Fujinomiya (JP)

(73) Assignee: Fujifilm Corporation, Tokyo (JP)

( * ) Notice: Subject to any disclaimer, the term of this patent is extended or adjusted under 35 U.S.C. 154(b) by 0 days.

(21) Appl. No.: 10/868,808

(22) Filed: Jun. 17, 2004

(65) Prior Publication Data

US 2004/0255743 A1 Dec. 23, 2004

(30) Foreign Application Priority Data

Jun. 19, 2003 (JP) ..... 2003-174783
Jun. 19, 2003 (JP) ..... 2003-174784

(51) Int. Cl.
*B26D 1/24* (2006.01)

(52) U.S. Cl. ..... 83/500; 83/676

(58) Field of Classification Search ..... 83/500–503, 83/505, 676, 345; 101/226
See application file for complete search history.

(56) References Cited

U.S. PATENT DOCUMENTS

| | | | | |
|---|---|---|---|---|
| 595,092 | A * | 12/1897 | Bosley | 83/102 |
| 5,423,239 | A * | 6/1995 | Sakai et al. | 83/500 |
| 6,431,037 | B1 * | 8/2002 | Dai et al. | 83/13 |
| 6,585,366 | B2 * | 7/2003 | Nagata et al. | 347/101 |
| 6,627,334 | B2 * | 9/2003 | Iida et al. | 428/847 |

FOREIGN PATENT DOCUMENTS

| | | | |
|---|---|---|---|
| JP | 4-244397 | A | 9/1992 |
| JP | 6-168444 | A | 6/1994 |
| JP | 2001 138285 | A | 5/2001 |
| JP | 2001-260077 | A | 9/2001 |
| JP | 2001-260077 | A | 9/2001 |
| JP | 2002-273690 | A | 9/2002 |

OTHER PUBLICATIONS

Hugo Klein; Coating, Verlag Coating Thomas & Co., vol. 28, No. 5, May 1, 1995, pp. 176-179.

* cited by examiner

*Primary Examiner*—Stephen Choi
(74) *Attorney, Agent, or Firm*—Birch, Stewart, Kolasch & Birch, LLP

(57) ABSTRACT

A discoid lower blade and a discoid upper blade, having a sharper knife angle compared with that of the lower blade, are arranged such that rotational axes thereof are parallel to each other, and portions of the blades overlap one another in the direction that the rotational axes extend. A sheet with a coating layer on one side is fed through and shear-cut between the upper and lower blades in the direction perpendicular to the rotational axes, with the surface of the sheet opposite the coating layer in contact with a periphery of the lower blade while the blades are rotated. When the sheet is shear-cut, a contact start position, where contact between the sheet and the upper blade starts, is positioned upstream in the feed direction of the sheet but outside a contacting area of the sheet, where the sheet contacts the periphery of the lower cutting blade.

3 Claims, 11 Drawing Sheets

COATED SHEET CUTTING METHOD AND APPARATUS

This Nonprovisional application claims priority under 35 U.S.C. § 119(a) on Patent Application No(s). JP 2003-174783 and JP 2003-174784 filed in JAPAN on Jun. 19, 2003, the entire contents of which are hereby incorporated by reference.

BACKGROUND OF THE INVENTION

1. Field of the Invention

The present invention relates to a method and apparatus for cutting coated sheets. Specifically, the present invention relates to a method and apparatus for cutting coated sheets by passing the coated sheets between opposing discoid cutting blades.

2. Description of the Related Art

Conventionally, there has been known a coated sheet that comprises a sheet substrate such as of paper, film, or resin-coated paper; and a coating layer formed on the sheet substrate, wherein the coating layer is filled with fine particles of silica or the like held together by a resin binder. Such a coated sheet is formed as a web through the steps of applying a liquid coating material to a long substrate, drying the coated substrate, and winding the dried substrate in a roll form. The web so obtained is then cut to a desired size by cutting the web in the web feed direction and/or cutting it in the cross web direction, i.e., the direction perpendicular to the web feed direction, while being unwound from the rolled web. After that, these cut sheets are brought to market as a final manufactured product such as information recording paper or the like. Typically, shear-cutting techniques are used for cutting such a web in its feed direction. In a shear cutting technique, the web of coated sheet is shear-cut by rotating a disk-shaped upper cutting blade having a keen or sharp knife angle and a disk-shaped lower cutting blade having a substantially right knife angle, while the coated sheet is passed through between the upper and lower cutting blade (for example, see Japanese Patent Publication No. 2001-260077).

However, as a variety of materials have been used upon request for manufacturing coated sheets in various manners, it becomes more difficult to select appropriate cutting conditions for shear-cutting the coated sheet while pulling out the coated sheet wound in a roll form, in the feed direction. If the cutting conditions are not properly selected, there arises a problem that cracks and/or flaws may be produced in the coating layer near the cut edges of the sheet. Especially, when the coating layer is hard and fragile, the aforementioned cracks and/or flaws could be conspicuously produced in the coating layer.

SUMMARY OF THE INVENTION

In view of the foregoing, it is an object of the invention to provide a method and apparatus for cutting a coated sheet, wherein the possible formation of cracks and flaws in a coating layer during shear-cutting the coated sheet is suppressed, whereby the deterioration of shear-cut quality can be prevented.

According to one aspect of the invention, there is provided a first method of cutting a coated sheet. This method comprises the steps of positioning a disk-shaped lower cutting blade and a disk-shaped upper cutting blade, which is disposed opposite the lower cutting blades and has a sharper knife angle compared with a knife angle of the lower cutting blade, such that rotational axes of the lower and upper cutting blades are arranged parallel to each other, and that a part of the lower cutting blade and a part of the upper cutting blade overlap one another in the direction that the rotational axes extend, the disk-shaped upper cutting blade; feeding a coated sheet with a coating layer on one side through between the upper and lower cutting blades in the direction perpendicular to the rotational axes with a surface of the coated sheet disposed on a side opposite the coating layer being maintained in contact with a periphery of the lower cutting while rotating the upper and lower cutting blades; and shear-cutting the coated sheet by the upper and lower cutting blades in the direction of feeding the coated sheet. When the coated sheet is subjected to shear-cutting, a contact start position where contact between the coated sheet and the upper cutting blade starts is positioned in a region which is located upstream in the feed direction of the coated sheet but outside a contacting area in the coated sheet where the coated sheet contacts with the periphery of the lower cutting blade.

According to another aspect of the invention, there is provided a first apparatus for cutting a coated sheet, comprising: a disk-shaped lower cutting blade; and a disk-shaped upper cutting blade disposed opposite the lower cutting blade. The upper cutting blades includes a sharper knife angle compared with a knife angle of the lower cutting blade, has a rotational axis parallel to a rotational axis of the lower cutting blade, and is arranged such that a part of the lower cutting blade and a part of the upper cutting blade overlap one another in the direction in which the rotational axes extend. In this apparatus, a coated sheet with a coating layer on one side is fed through between the upper and lower cutting blades in the direction perpendicular to the rotational axes with a surface of the coated sheet disposed on a side opposite the coating layer being maintained in contact with a periphery of the lower cutting blade while the upper and lower cutting blades are rotated, and thereby the coated sheet is shear-cut in the direction along the feed direction of the coated sheet. A contact start position where contact between the coated sheet and the upper cutting blade starts is positioned in a region which is located upstream in the feed direction of the coated sheet but outside a contacting area in the coated sheet where the coated sheet contacts with the periphery of the lower cutting blade.

According to another aspect of the invention, there is provided a second method of cutting a coated sheet. This method comprises the steps of positioning a disk-shaped lower cutting blade and a disk-shaped upper cutting blade, which is disposed opposite the lower cutting blades and has a sharper knife angle compared with a knife angle of the lower cutting blade, such that rotational axes of the lower and upper cutting blades are arranged parallel to each other, and that a part of the lower cutting blade and a part of the upper cutting blade overlap one another in the direction that the rotational axes extend, the disk-shaped upper cutting blade; feeding a coated sheet with a coating layer on one side through between the upper and lower cutting blades in the direction perpendicular to the rotational axes with a surface of the coated sheet disposed on a side opposite the coating layer being maintained in contact with a periphery of the lower cutting while rotating the upper and lower cutting blades; and shear-cutting the coated sheet by the upper and lower cutting blades in the direction of feeding the coated sheet. When the coated sheet is subjected to shear-cutting, a contact start position where contact between the coated sheet and the upper cutting blade starts is positioned within a contacting area where the coated sheet contacts with the periphery of the lower cutting blade, and the overlap amount of between a part of the upper cutting blade and a part of the lower cutting blades is maintained to be not more than 1.5 mm.

According to another aspect of the invention, there is provided a second apparatus for cutting a coated sheet, comprising a disk-shaped lower cutting blade; and a disk-shaped upper cutting blade disposed opposite the lower cutting blade. The upper cutting blades includes a sharper knife angle compared with a knife angle of the lower cutting blade, has a rotational axis parallel to a rotational axis of the lower cutting blade, and is arranged such that a part of the lower cutting blade and a part of the upper cutting blade overlap one another in the direction in which the rotational axes extend. In this apparatus, a coated sheet with a coating layer on one side is fed through between the upper and lower cutting blades in the direction perpendicular to the rotational axes with a surface of the coated sheet disposed on a side opposite the coating layer being maintained in contact with a periphery of the lower cutting blade while the upper and lower cutting blades are rotated, and thereby the coated sheet is shear-cut in the direction along the feed direction of the coated sheet. A contact start position where contact between the coated sheet and the upper cutting blade starts is positioned within a contacting area where the coated sheet contacts with the periphery of the lower cutting blade, and the overlap amount of between a part of the upper cutting blade and a part of the lower cutting blades is maintained to be not more than 1.5 mm.

As used herein, an "overlap amount W" means the width of overlap, between both upper and lower cutting blades on the line extending through the rotational axes thereof, viewed looking along the direction of the rotational axes.

The coated sheet may be constituted by a substrate such as a paper sheet, film, or resin coated sheet or the like, and a coating layer that is layered on the substrate. The coating layer is filled with fine particles, for example, mainly composed of inorganic materials including calcium carbonate, hydrated alumina, or silica which are held together by a resin binder or the like.

The coated sheet may be a recording sheet for inkjet printing. The recording sheet for inkjet printing may be constituted by a substrate such as a paper sheet, a film, or a resin coated sheet; and a coating layer which is layered on the substrate. The coating layer is filled with fine particles, for example, mainly composed of silica, which are held together by a resin binder such as poly vinyl alcohol. Especially, a gloss photo paper sheet for inkjet printing contains a smaller amount of binder which holds together fine particles such as silica in order to enhance the ink absorbency of the sheet. Thus it has a nature that the connection between fine particles is easily broken by an external force such as bending.

As used herein, a "contact start position of the coated sheet and upper cutting blade" means a most upstream position, along the feed direction in which the coated sheet is fed, of the region where the coated sheet and the upper cutting blade contact one another during the coated sheet is subjected to shear cutting.

According to the first method and apparatus for cutting a coated sheet, when the coated sheet is subjected to shear-cutting, a contact start position where contact between the coated sheet and the upper cutting blade starts is positioned in a region which is located upstream in the feed direction of the coated sheet but outside a contacting area in the coated sheet where the coated sheet contacts with the periphery of the lower cutting blade. Thus, only the upper cutting blade can make a cut-in in the coating layer before the coating layer is passed through and subjected to shear-cutting between the upper and lower cutting blades. This contributes to suppressing the production of a large stress that could cause cracks and flaws in the coating layer during shear-cutting, whereby the deterioration of shear-cut quality can be prevented.

According to the second method and apparatus for cutting a coated sheet, when the coated sheet is subjected to shear-cutting, a contact start position where contact between the coated sheet and the upper cutting blade starts is positioned within a contacting area where the coated sheet contacts with the periphery of the lower cutting blade, and the overlap amount of between a part of the upper cutting blade and a part of the lower cutting blades is maintained to be not more than 1.5 mm during shear-cutting. As a result, the amount of press-bending that the coated sheet undergoes during shear-cutting by the upper cutting blade can be reduced, and in turn the partial deformation of the coated sheet can be decreased. This contributes to suppress possible formation of cracks and flaws in a coating layer during shear-cutting, whereby the deterioration of shear-cut quality can be prevented.

DESCRIPTION OF THE PREFERRED EMBODIMENTS

Hereinafter, a first embodiment of the present invention will be described in detail with reference to the drawings.

Figure 1:
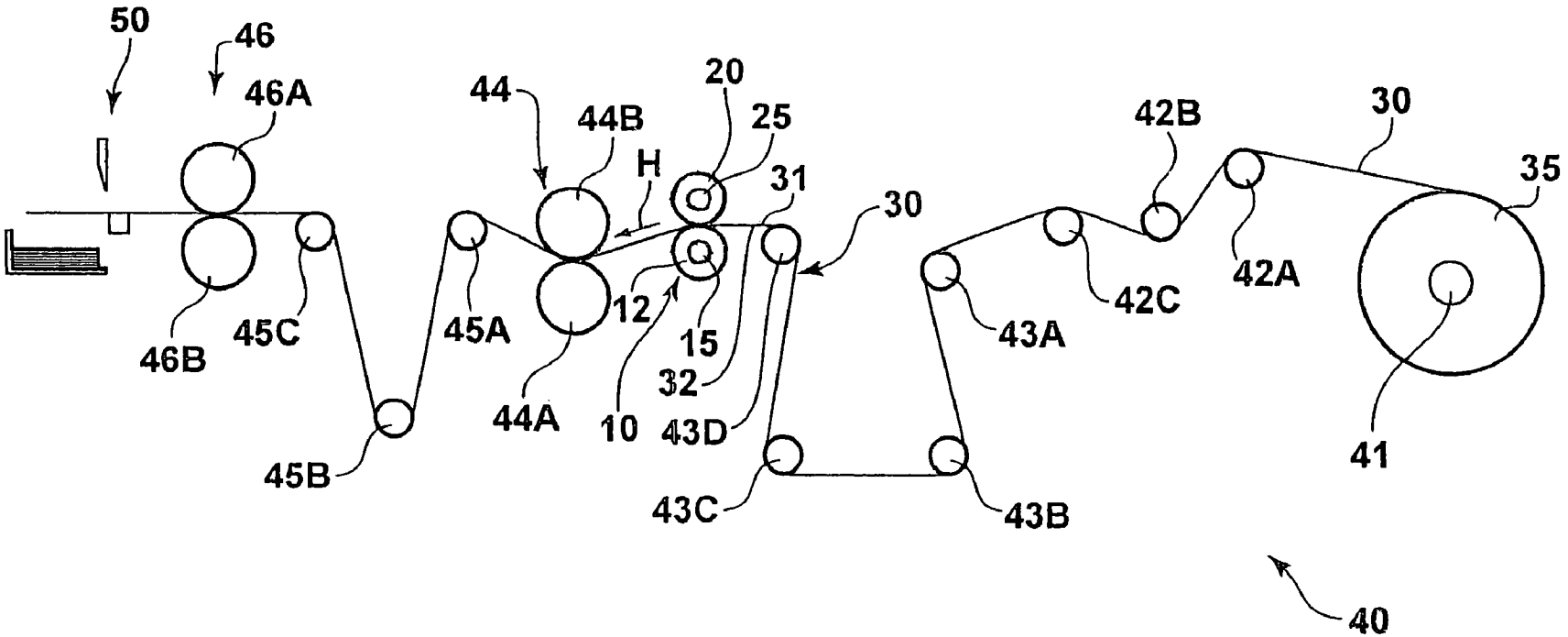
FIG. 1 is a side view showing a schematic structure of a coated sheet cutting apparatus for carrying out a coated sheet cutting method according to an embodiment of the invention.

A coated sheet cutting apparatus shown in FIG. 1 comprises a disk-shaped lower cutting blade 10, a lower-blade rotating motor 15 for rotating the lower cutting blade 10, a disk-shaped upper cutting blade 20 disposed opposite the lower cutting blade 10, an upper-blade rotating motor 25 for rotating the upper cutting blade 20, and a feed section 40 for feeding a long coated sheet 30.

Figure 2:
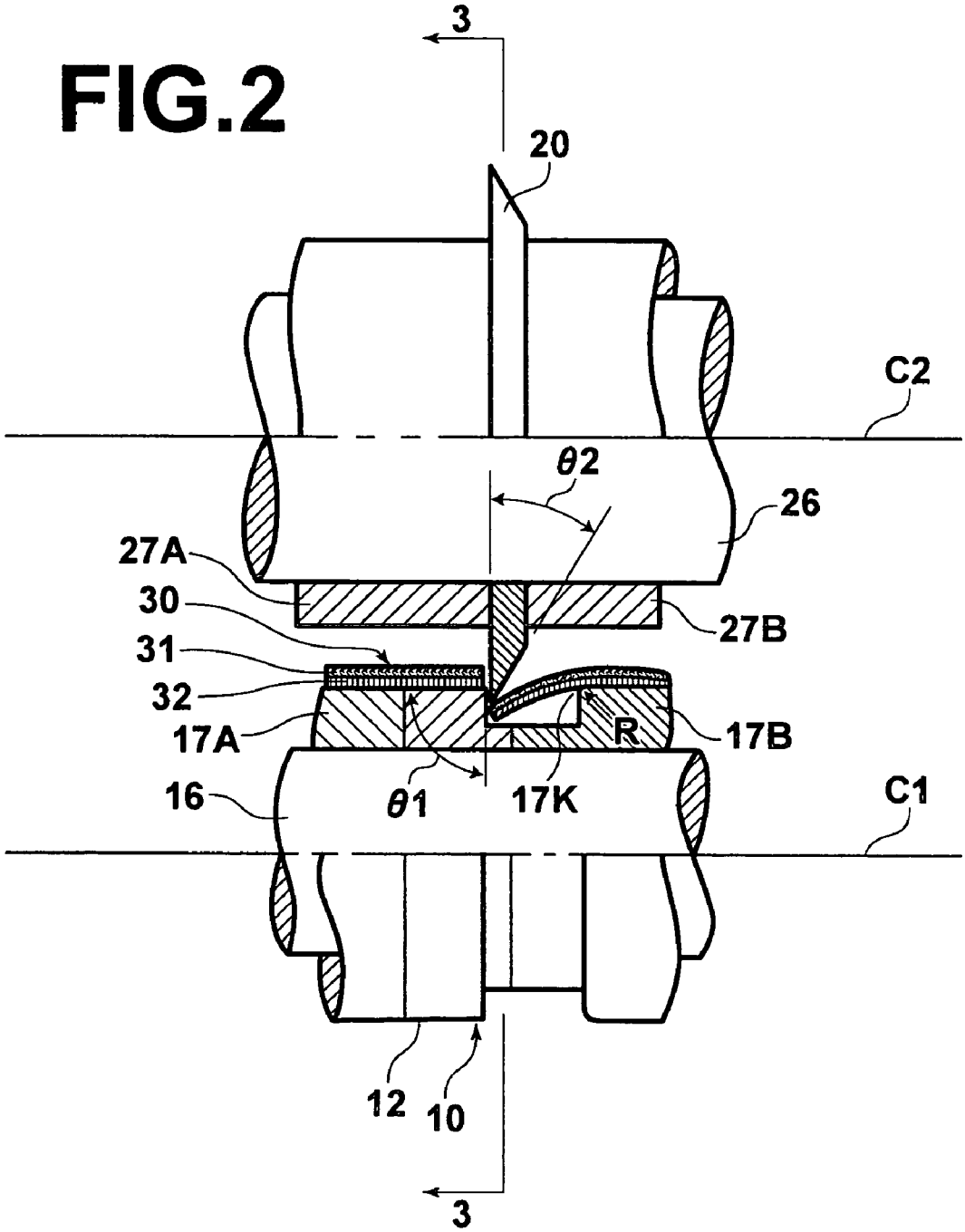
FIG. 2 is an enlarged partially broken away elevation view of the coated sheet cutting apparatus in FIG. 1, showing the positional relationship between a lower cutting blade, an upper cutting blade, and a coated sheet.
Figure 3:
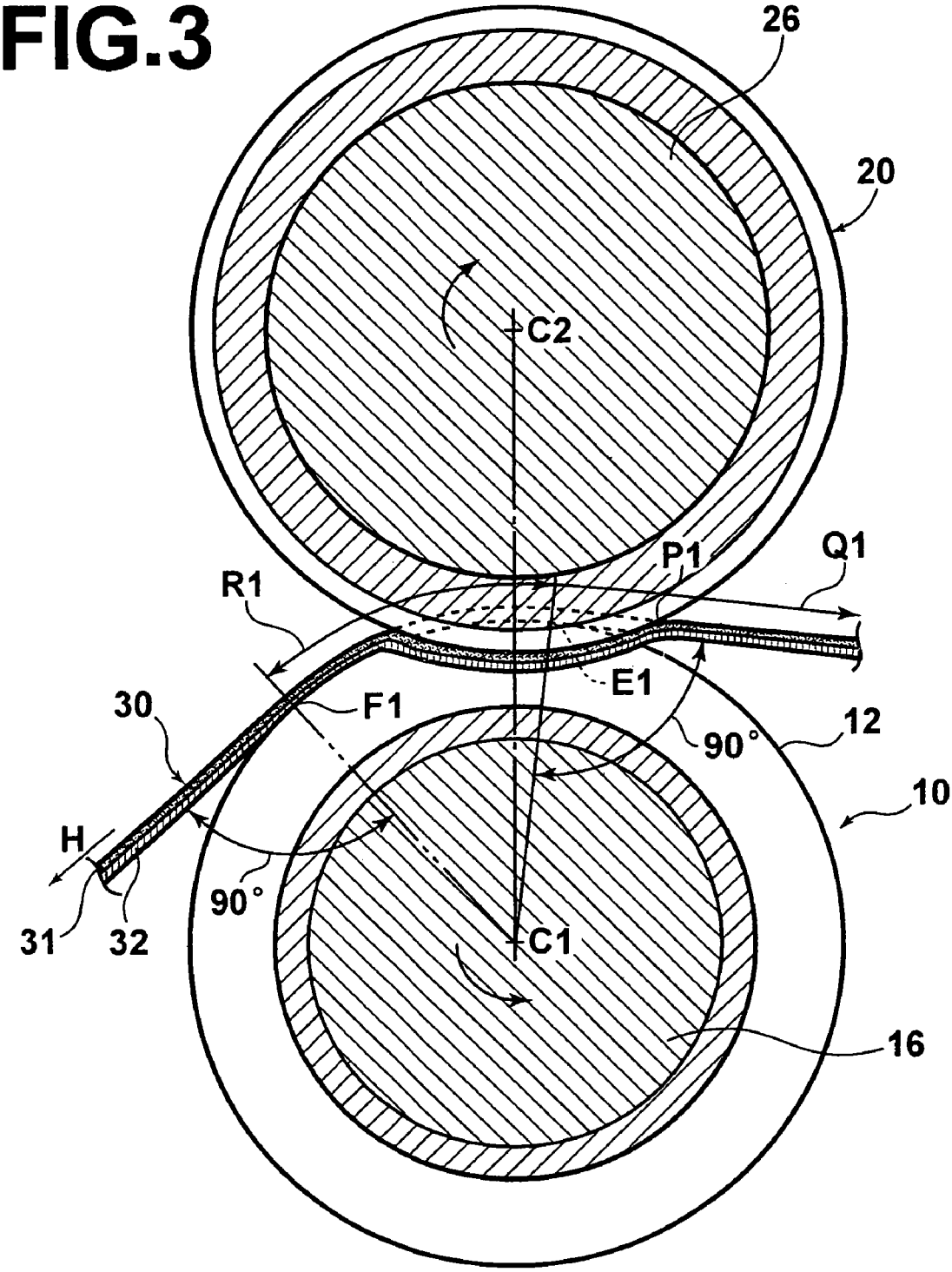
FIG. 3 is a cross sectional view of the coated sheet cutting apparatus taken along line 3-3 of FIG. 2.

As shown in FIGS. 2 and 3, the coated sheet 30 is manufactured by layering a coating layer 31, in which silica-based fine particles are held together by a resin binder such as polyvinyl alcohol, onto a substrate 32 which is, for example, resin-coated paper or the like. This coated sheet 30 is unwound from the sheet roll 35 which is a web wound in a roll form. The coated sheet 30 mentioned above is a recording sheet for inkjet printing. Besides the resin-coated paper, conventional paper, film and the like may be employed as a material for the substrate 32 of the coated sheet. The coating layer 31 mentioned above is harder and more fragile than the substrate 32.

As also shown in FIGS. 2 and 3, the lower cutting blade 10 and the upper cutting blade 20 are positioned such that a rotational axis C1 of the lower cutting blade 10 and a rotational axis C2 of the upper cutting blade 20 are arranged parallel to each other, and that a part of the lower cutting blade 10 and a part of the upper cutting blade 20 overlap one another in the direction that the rotational axes C1 and C2 extend, that is, a part of the lower cutting blade 10 and a part of the upper cutting blade 20 are superimposed one another when viewed looking along the direction that the rotational axes C1 and C2 extend. A knife angle θ2 of the upper cutting blade 20 is smaller than a knife angle θ1 of the lower cutting blade 10.

The lower cutting blade 10 is fitted around and engaged with the periphery of a lower-blade shaft 16 which is connected to a rotary shaft of a lower-blade rotating motor 15. The lower cutting blade 10 is clamped between a lower-blade spacer 17A and another lower-blade spacer 17B, both of which are fitted around and engaged with the periphery of the lower-blade shaft 16. This allows the lower cutting blade 10 to rotate in cooperation with the lower-blade shaft 16.

A curvature radius of a rounded corner 17K of the lower-blade space 17B is 1.5 mm (that is, the curvature radius "R" of the chamfered corner=1.5 mm).

On the other hand, the upper cutting blade 20 is fitted around and engaged with the periphery of an upper-blade shaft 26 which is connected to a rotary shaft of an upper-blade rotating motor 25. The upper cutting blade 20 is clamped between an upper-blade spacer 27A and another upper-blade space 27B, both of which are fitted around and engaged with the periphery of the upper-blade shaft 26, as a result of which the upper cutting blade 20 rotates in cooperation with the upper-blade shaft 26.

The feed section 40 comprises: a roll holding shaft 41 for rotatably holding a sheet roll 35 on the rotary shaft thereof; a sheet pullout roller section 44 for unwinding pulling out a coated sheet 30 from the sheet roll 35 held by the roll holding shaft 41; pass rolls 42A, 42B, 42C and 43A, 43B, 43C, 43D which are arranged along the feed path of the coated sheet 30 from the roll holding shaft 41 to the sheet pullout section 44 and serve to change the feed direction of the coated sheet 30 while properly maintaining the tension in the feed direction applied to the coated sheet 30; a shear-cut sheet supply roller section 46 for supplying a sheet-cutting section 50 with the coated sheet 30 which has been pulled out by the sheet pullout roller section 44 and passed between and shear-cut by the lower cutting blade 10 and upper cutting blade 20; and pass rolls 45A, 45B, 45C which are arranged between the sheet pullout roller section 44 and the shear-cut sheet supply roller section 46 and serve to change the feed direction of the coated sheet 30 while properly maintaining the tension applied to the coated sheet 30.

The position where the coated sheet 30 is passed through between the lower cutting blade 10 and upper cutting blade 20 and shear-cut thereby is located partway along the feed path segment between the pass roll 43D and the sheet pullout roller section 44. A contact start position, described later, is determined based on the positional relationship between the pass roll 43D, the lower cutting blade 10, and the upper cutting blade 20, while a contacting area described later is determined based on the positional relationship between the sheet pullout roller section 44, the pass roll 43D and the lower cutting blade 10.

The sheet pullout roller section 44 clamps the coated sheet 30 between two rotary rollers 44A and 44B, and unwinds the coated sheet 30 from the sheet roll 35 for feeding. The shear-cut sheet supply roller section 46 supplies the coated sheet 30 to the sheet cutting section 50 through the nip between two rollers 46A, 46B which are intermittently rotated such that the coated sheet 30 is cut in predetermined length at the sheet cutting section 50.

The feed section 40 mentioned above feeds the coated sheet 30 in the direction H perpendicular to the aforementioned rotational axis C1 through between the lower cutting blade 10 and the upper cutting blade 20, while maintaining the surface of the substrate 32 of the coated sheet 30 on a side opposite the coating layer 31 in contact with a periphery 12 of the lower cutting blade 10. The sheet cutting section 50 cuts the coated sheet 30 supplied through the shear-cut sheet supply roller section 46 in the direction perpendicular to the feed direction of the coated sheet 30.

In the following, the process for cutting a coated sheet 30 by means of the coated sheet cutting apparatus of this embodiment will be described in detail.

The coated sheet 30 is clamped between the two rollers 44A and 44B of the sheet pullout roller 44, and unwound from the sheet roll 35 for feeding. The coated sheet 30 is delivered via the pass rolls 42A to 43D and passed through the nip between the lower cutting blade 10 rotating under the drive of the lower-blade rotating motor 15 and the upper cutting blade 20 rotating under the drive of the upper-blade rotating motor 25, where the coated sheet 30 is cut by the rotating lower and upper cutting blade 10, 20 in the sheet feed direction (in the direction shown by arrow H in FIG. 1).

In the coated sheet cutting apparatus of the first embodiment, when shear-cutting the coated sheet 30, a contact start position P1 where the coated sheet and the upper cutting blade 20 start contacting is disposed within a non-contacting area Q1 as shown in FIG. 3. The non-contacting area Q1 is outside the contacting area R1 where the coated sheet contacts with the periphery of the lower cutting blade 10, and located upstream with respect to the feed direction of the coated sheet 30. Then, the coated sheet is subjected to shear-cutting.

Here, the contacting area R1 is the area extending from a lower-blade capture start position E1, where the contacting between the lower cutting blade 10 and the coated sheet 30 starts, to a lower-blade capture end position F1, where the contacting between the lower cutting blade 10 and the coated sheet 30 ends. The contact start position P1 is located at the most upstream position, along the foregoing feed direction, of the area where the coated sheet 30 contacts the upper cutting blade 20. The angle formed between a straight line, which extends through the rotational axis C1 of the lower cutting blade 10 and the lower-blade capture start position E1, and the coated sheet 30, which extends toward upstream in the feed direction, is substantially 90°, and the angle formed between another straight line, which extends through the rotational axis C1 mentioned above and the lower-blade capture end position F1, and the coated sheet 30 extending toward downstream in the feed direction is also substantially a right angle.

The coated sheet 30, which has been shear-cut while being passed through between the aforementioned lower cutting blade 10 and upper cutting blade 20, is passed through the sheet pullout roller section 44, guided via the aforementioned pass rolls 45A to 45C, threaded through the nip between two feed rollers 46A, 46B of the shear-cut sheet supply roller section 46, and finally delivered to the sheet-cutting section 50. Thus, the sheet-cutting section 50 cuts the delivered coated sheet 30 in the direction perpendicular to the feed direction.

Hereinafter, a description will be given on cutting-tests performed for evaluating the relationship between the position of the contact start position P1 with respect to the contacting area R1 and the shear-cut quality of the coated sheet 30, which is shear-cut while being passed between the lower cutting blade 10 and the upper cutting blade 20.

Figure 4:
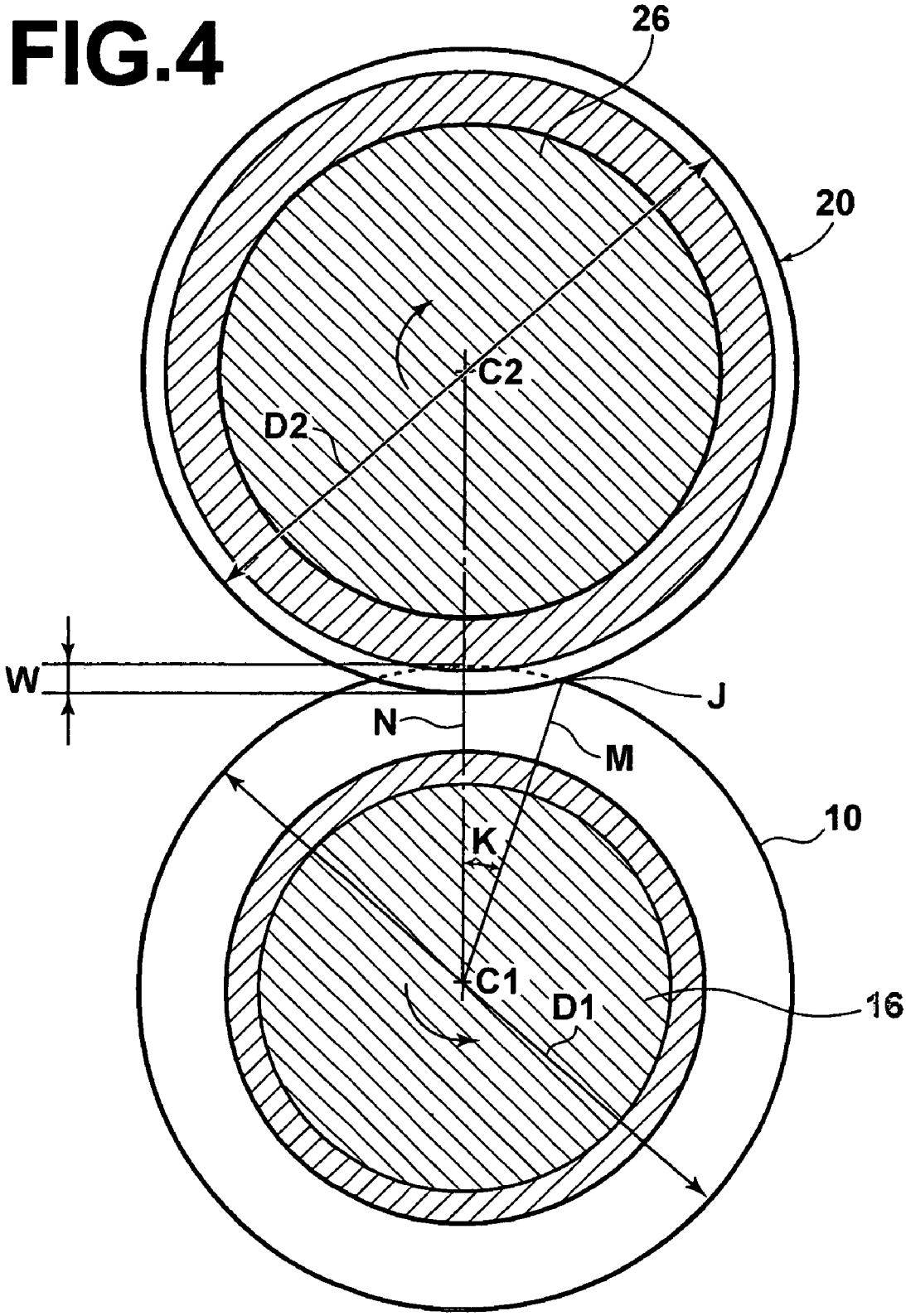
FIG. 4 is a cross sectional view showing the dimensions of the upper and lower cutting blades and the detail of the positional relationship between these upper and lower cutting blades.

As shown in FIG. 4, the outer diameter D1 of the lower cutting blade 10 is 110 mm, the outer diameter D2 of the upper cutting blade 20 is 138 mm, an overlap amount W where a part of the lower cutting blade 10 and a part of the upper cutting blade overlap one another is 1 mm. In a side view in section looking along the rotational axis (that is, in FIG. 4), a straight line M, which extends through the portion J that is the most upstream position along the feed direction of the zone where the upper cutting blade 20 and lower cutting blade 10 overlap each, and further through the rotational axis C1 of the lower cutting blade 10, and a straight line N, which extends through the rotational axis C1 and the rotational axis C2, form an upper and lower cutting blades engagement start angle K which is about 8.2°. Here, the term "overlap amount W" means the width of overlap, between both blades on the line extending through the rotational axes C1 and C2 thereof, viewed looking along the direction of the rotational axes.

Figure 5:
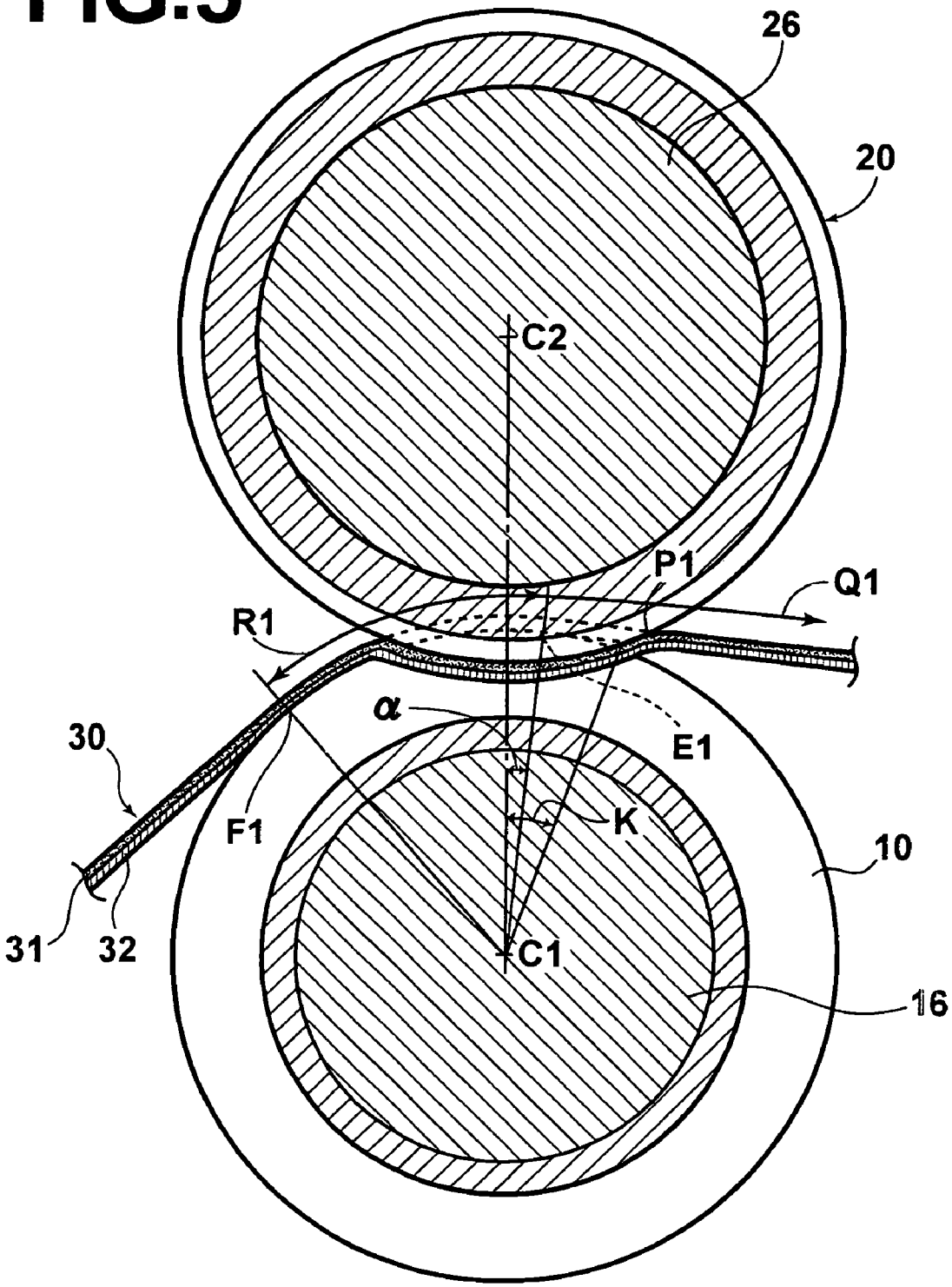
FIG. 5 is a cross sectional view showing a state that a contact start position is outside a contacting area.

Further, as shown in FIG. 5, a straight line extending through the rotational axes C1 and C2 and another straight line extending through the rotational axis C1 and the lower-blade capture start position E1 forms an angle which is referred to as a lower-blade capture start angle α.

When the thickness of the coated sheet 30 is sufficiently small compared with the diameter of the lower cutting blade 10, the requirement for the contact start position P1 to be located outside the contacting area R1 is given by: the lower-blade capture start angle α<the upper and lower cutting blades engagement start angle K. The value of the lower-blade capture start angle α is equal to the value of the upper and lower cutting blades engagement start angle K when the lower-blade capture start position E1 matches the aforementioned contact start position P1. Therefore, when the requirement given by "the lower-blade capture start angle α<the upper and lower cutting blades engagement start angle K" is satisfied, the contact start position P1 is included in the non-contacting area Q1 (that is, outside the contacting area R1). In the first embodiment, since the thickness of the coated sheet is sufficiently small compared with the diameter of the lower cutting blade (the diameter of the lower cutting blade is 110 mm, whereas the thickness of the coated sheet is about 0.3 mm), the aforementioned requirement "the lower-blade capture start angle α<the upper and lower cutting blades engagement start angle K" is the requirement for the contact start position P1 to be outside the contacting area R1. The shear-cut quality was evaluated under the foregoing condition while changing the lower-blade capture start angle α, and the results were summarized in Table 1.

TABLE 1

| lower-blade capture start angle (α) | shear-cut quality | |
|---|---|---|
| (deg.) | Crack | flaw |
| 5.0° | E | E |
| 7.0° | E | E |
| 8.0° | G | G |
| 9.0° | NG | NG |
| 11.0° | NG | NG |

E: excellent, G: good, NG: not good

First, a description will be given for the case where the contact start position P1 is outside the contacting area R1 (i.e., α<8.2°).

When the lower-blade capture start angle α was 5.0° or 7.0°, the upper and lower cutting blades engagement start angle K was, as shown in FIG. 5, larger than the lower-blade capture start angle α (i.e., the lower-blade capture start angle α<the upper and lower cutting blades engagement start angle K), and the defect-free quality concerning cracks and flaws, i.e., the shear-cut quality, of the coating layer 31 of the shear-cut coated sheet 30 was fairly good as shown in Table 1. That is, when the coated sheet was shear-cut, the upper cutting blade 20 could make a cut-in in the coating layer 31 before the coating layer 30 is clamped between the upper and lower cutting blades, and shear-cutting was performed without producing a large stress which might cause cracks and flaws in the coating layer 31.

Figure 6:
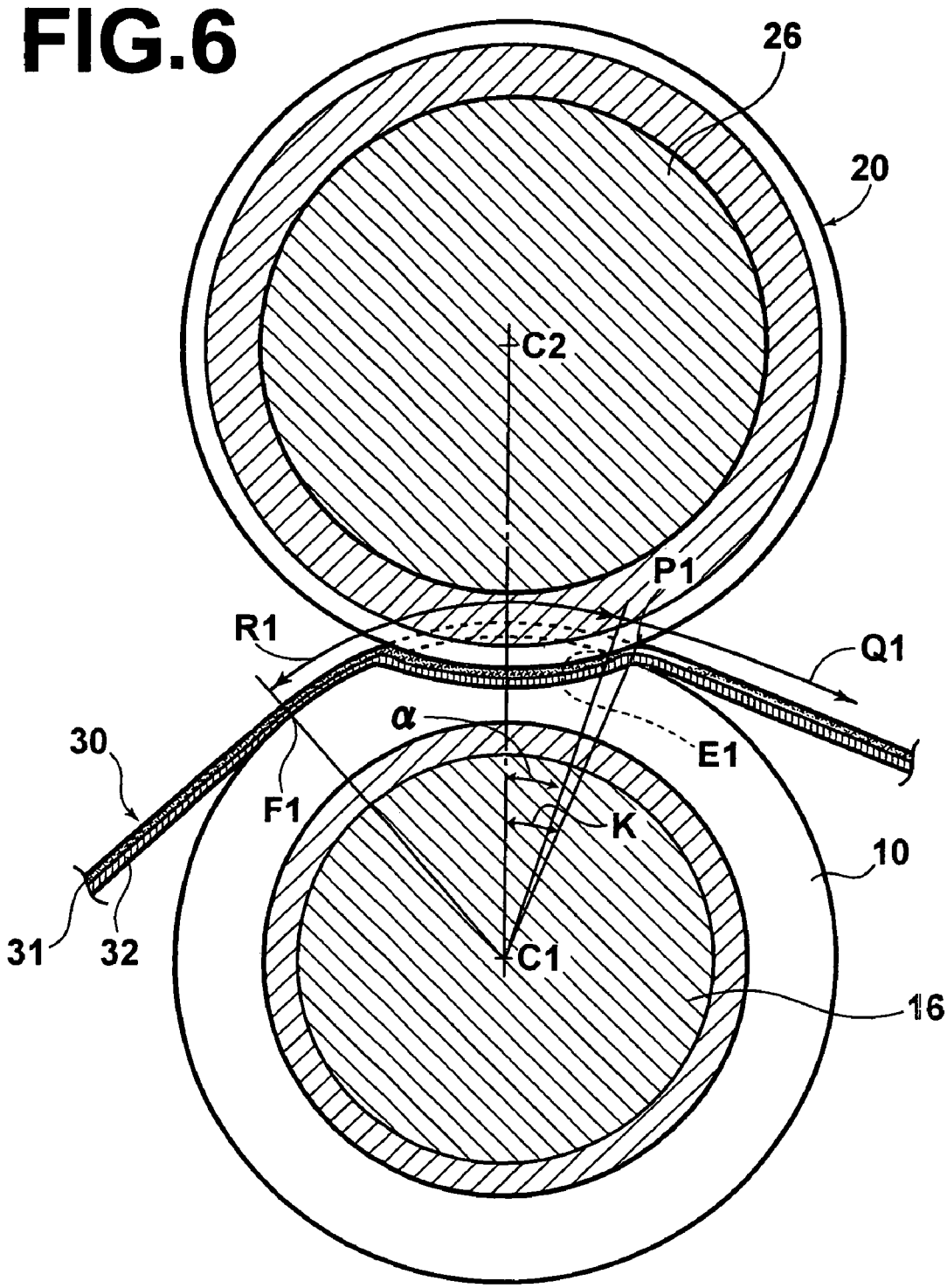
FIG. 6 is a cross sectional view showing a state that the contact start position is near the contacting area.

When the lower-blade capture start angle α was 8.0°, the upper and lower cutting blades engagement start angle K was still larger than the lower-blade capture start angle α (i.e., the lower-blade capture start angle α<the upper and lower cutting blades engagement start angle K). However, as shown in FIG. 6, the lower-blade capture start angle α (8.0°) fairly is near the upper and lower cutting blades engagement start angle K (8.2°). Even in such a case, quality deterioration concerning cracks and flaws mentioned above was low, and the shear-cut quality was good as shown in Table 1.

Figure 7:
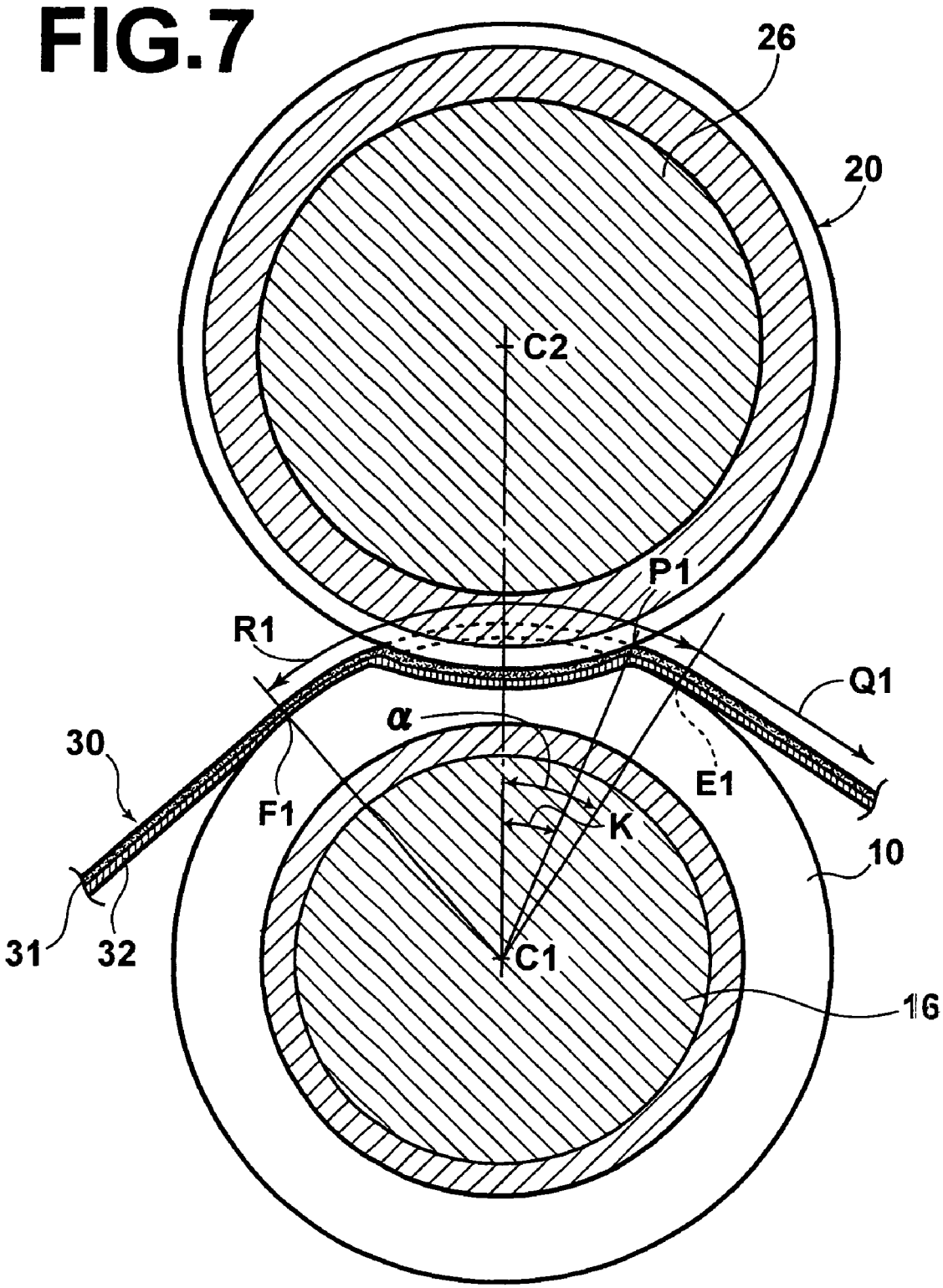
FIG. 7 is a cross sectional view showing a state that the contact start position is within the contacting area.

When the lower-blade capture start angle α was 9.0° or 11.0°, the contact start position P1 was included in the contacting area R1, and the lower-blade capture start angle α exceeded the upper and lower cutting blades engagement start angle K (8.2°), and as shown in FIG. 7, the lower blades engagement start angle K became smaller than the lower-blade capture start angle α (i.e., the lower-blade capture start angle α>the upper and lower cutting blades engagement start angle K). In this case, a large number of cracks and flaws were produced in the coating layer as shown in Table 1, and the shear-cut quality deteriorates. In other words, since the coating sheet 30 clamped and shear-cut between the upper and lower cutting blades without a cut-in made in the coating layer 31 by the upper cutting blade 20, a large stress which might cause cracks and flaws in the coating layer 31 was produced.

While the foregoing embodiment employs a recording sheet for inkjet printing as a coated sheet, this invention is not limited thereto. Similar effects can also be obtained by any other coated sheets produced by layering a coating layer on a substrate which is, for example, a paper sheet, a film, or a resin coated sheet. The coating layer is filled with fine particles mainly composed of inorganic materials including calcium carbonate, hydrated alumina, and silica which are held together by a resin binder or the like.

The cutting test described above was conducted while varying the thickness of the coating layer from 0.01 mm to 0.1 mm and the thickness of the coated sheet including the thickness of the coating layer from 0.1 mm to 0.5 mm. Any change in shear-cut quality was not found in both cases.

The thickness of a coated sheet to be shear-cut by the coated sheet cutting apparatus of the invention is preferably not less than 0.01 mm but not more than 0.1 mm, and more preferably not less than 0.02 mm but not more than 0.05 mm.

It was separately found that change in shear-cut quality was slight even when one or more shear-cutting conditions including the diameter of the upper cutting blade, the diameter of the lower cutting blade, and sheet federate are changed, whereas the shear-cut quality was mainly determined depending on whether or not the aforementioned contact start position was located outside the contacting area.

Figure 8:
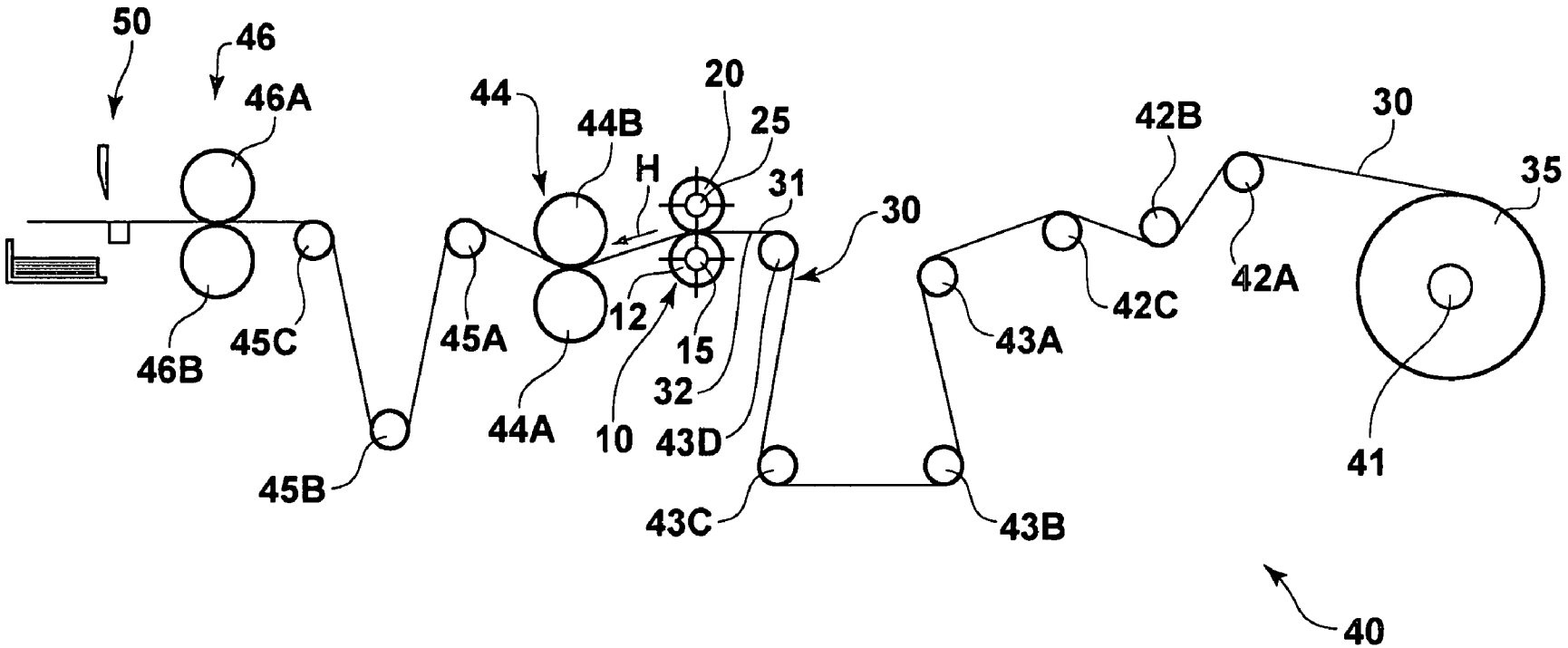
FIG. 8 is a side view showing a schematic structure of a coated sheet cutting apparatus for carrying out a coated sheet cutting method according to another embodiment of the invention.
Figure 9:
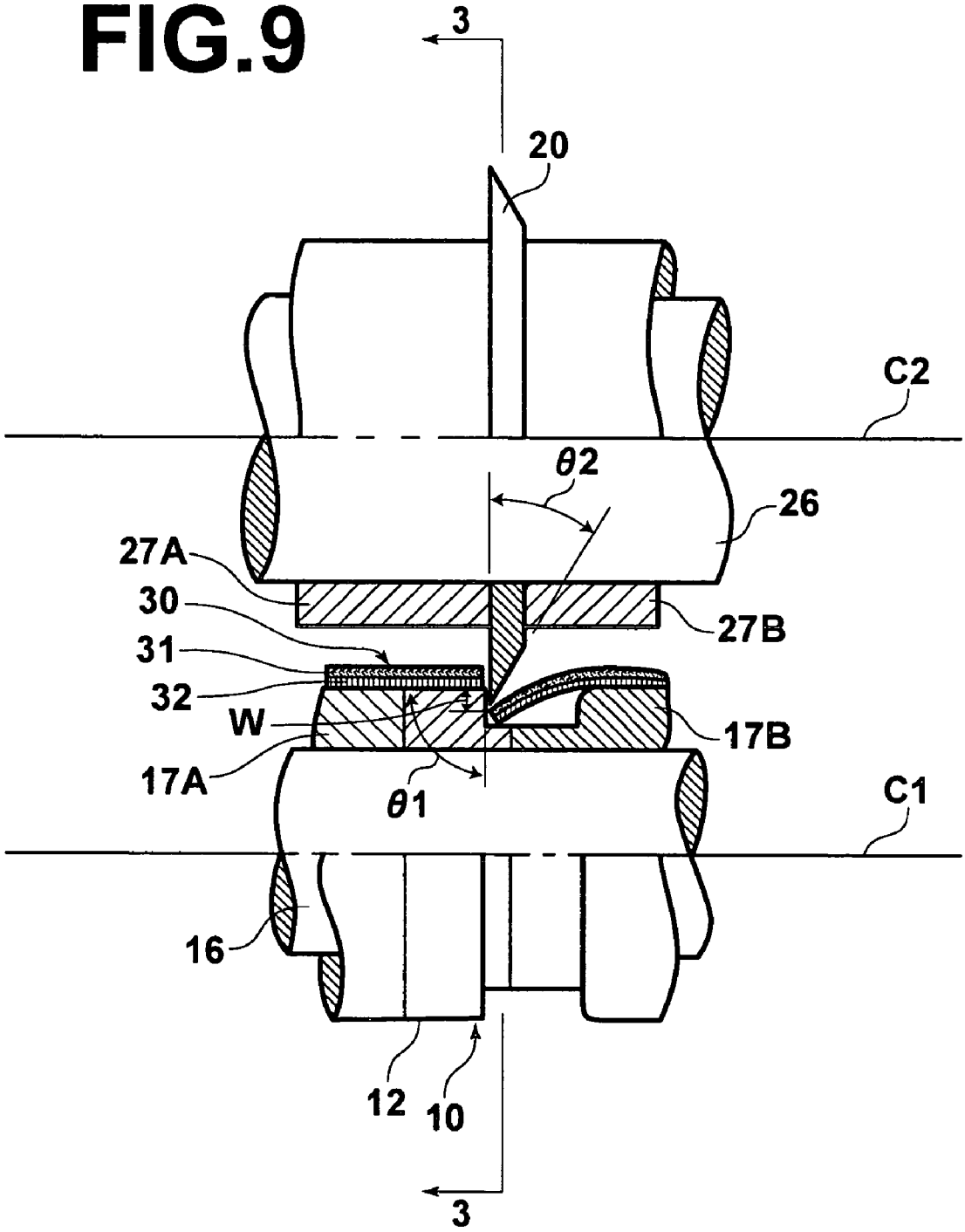
FIG. 9 is an enlarged partially broken away elevation view of the coated sheet cutting apparatus in FIG. 8, showing the positional relationship between a lower cutting blade, an upper cutting blade, and a coated sheet.
Figure 10:
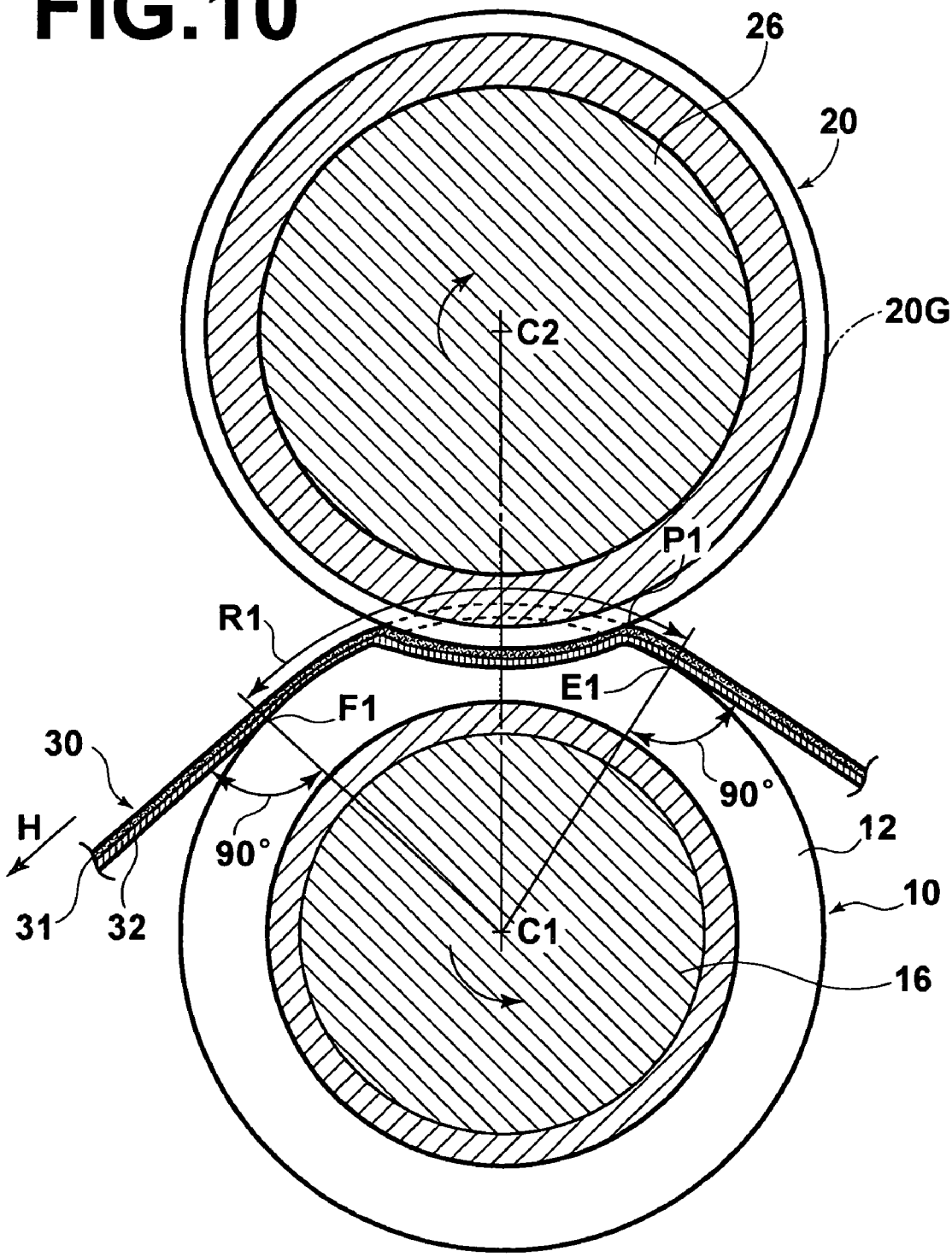
FIG. 10 is a cross sectional view of the coated sheet cutting apparatus taken along line 3-3 of FIG. 9.
Figure 11:
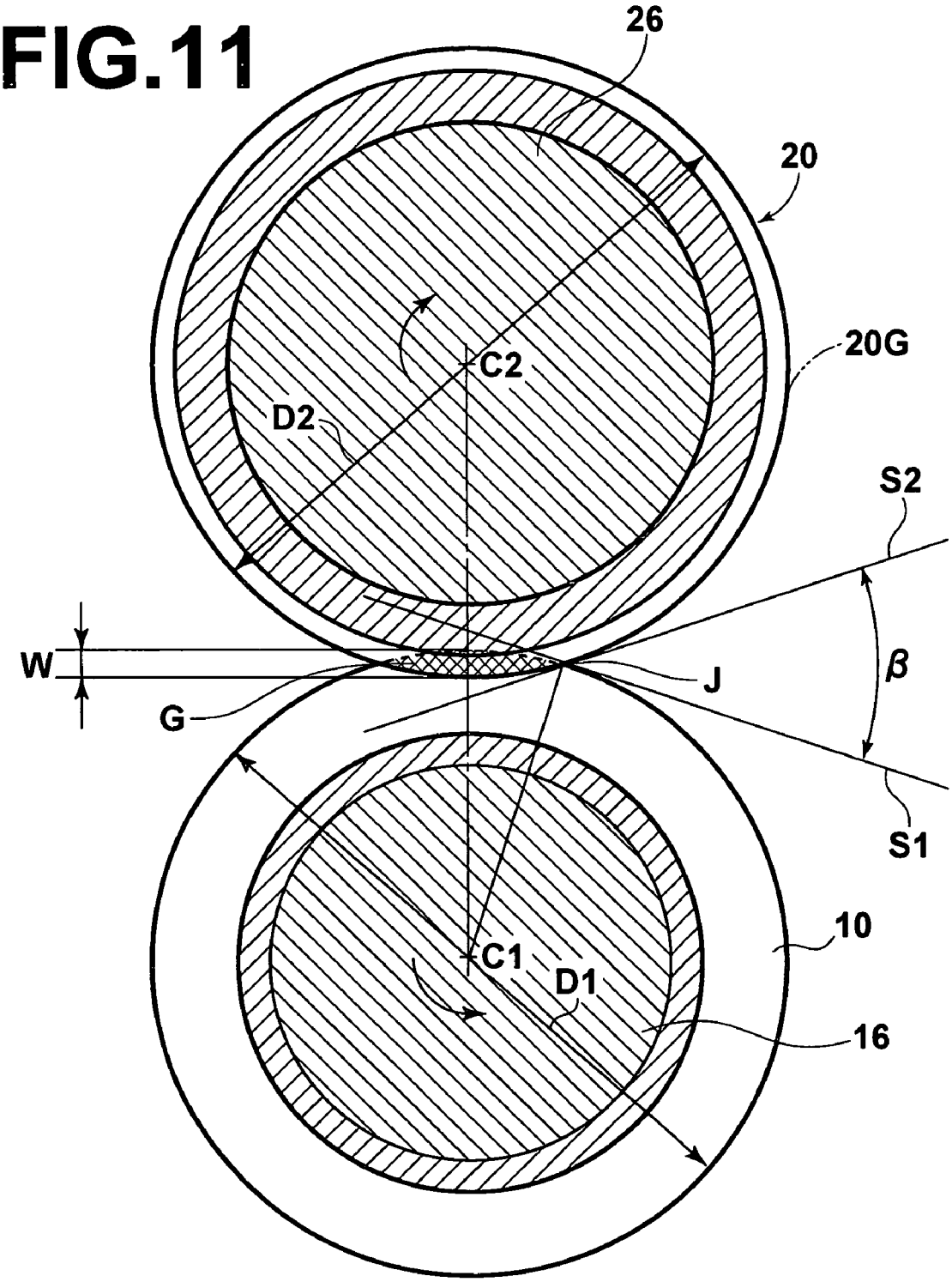
FIG. 11 is a cross sectional view showing the dimensions of the upper and lower cutting blades and the detail of the positional relationship of the blades to each other.

Hereinafter, a second embodiment of the present invention will be described in detail with reference to the relevant drawings. FIG. 8 is a side view showing a schematic structure of a coated sheet cutting apparatus for carrying out a coated sheet cutting method according to a second embodiment of the invention, FIG. 9 is an enlarged partially broken away elevation view showing the positional relationship between a lower cutting blade, an upper cutting blade, and a coated sheet, FIG. 10 is a cross sectional view taken along line 3-3 of FIG. 9, and FIG. 11 is a cross sectional view showing the dimensions of the upper and lower cutting blades and the detail of the positional relationship between the upper and lower cutting blades to each other. In FIGS. 8 to 11, the same reference numerals as used in the first embodiment are used to denote elements having the same feature as those of the first embodiment.

A coated sheet cutting apparatus shown in FIG. 8 comprises a disk-shaped lower cutting blade 10, a lower-blade rotating motor 15 for rotating the lower cutting blade 10, a disk-shaped upper cutting blade 20 disposed opposite the lower cutting blade 10, an upper-blade rotating motor 25 for rotating the upper cutting blade 20, and a feed section 40 for feeding a long coated sheet 30.

The coated sheet 30 is manufactured by layering a coating layer 31, in which silica-based fine particles are held together by a resin binder such as polyvinyl alcohol, onto a substrate 32 which is, for example, a resin coated paper or the like. This coated sheet 30 is unwound from the sheet roll 35 which is a web wound in a roll form. The coated sheet 30 mentioned above is a recording sheet for inkjet printing. Besides the resin-coated paper, conventional paper, film and the like may be employed as the substrate 32 of the coated sheet. The coating layer 31 mentioned above is harder and more fragile than the substrate 32.

As shown in FIGS. 9 and 10, the lower cutting blade 10 and the upper cutting blade 20 are positioned such that a rotational axis C1 of the lower cutting blade 10 and a rotational axis C2 of the upper cutting blade 20 are arranged parallel to each other, and that a part of the lower cutting blade 10 and a part of the upper cutting blade 20 overlap one another in the direction that the rotational axes C1 and C2 extend, that is, a part of the lower cutting blade 10 and a part of the upper cutting blade 20 are superimposed one another when viewed along the direction that the rotational axes C1 and C2 extend (see FIG. 10). A knife angle θ2 of the upper cutting blade 20 is smaller than a knife angle θ1 of the lower cutting blade 10.

The lower cutting blade 10 is fitted around and engaged with the periphery of a lower-blade shaft 16 which is connected to a rotary shaft of a lower-blade rotating motor 15. The lower cutting blade 10 is clamped between a lower-blade spacer 17A and another lower-blade spacer 17B, both of which are fitted around and engaged with the periphery of the lower blade shaft 16, as a result of which the lower cutting blade 10 rotates in cooperation with the lower-blade shaft 16.

On the other hand, the upper cutting blade 20 is fitted around and engaged with the periphery of an upper-blade shaft 26 which is connected to a rotary shaft of an upper-blade rotating motor 25. The upper cutting blade 20 is clamped between an upper-blade spacer 27A and another upper-blade space 27B, both of which are fitted around and engaged with the periphery of the upper blade shaft 26, as a result of which the upper cutting blade 20 rotates in cooperation with the upper-blade shaft 26.

The feed section 40 comprises: a roll holding shaft 41 for rotatably holding a sheet roll 35 on the rotary shaft; a sheet pullout roller section 44 for pulling out a coated sheet 30 from the sheet roll 35 held by the roll holding shaft 41; pass rolls 42A, 42B, 42C and 43A, 43B, 43C, 43D which are arranged along the feed path of the coated sheet 30 from the roll holding shaft 41 to the sheet pullout section 44 and serve to change the feed direction of the coated sheet 30 and properly maintain the tension in the feed direction applied to the coated sheet 30; a shear-cut sheet supply roller section 46 for supplying a sheet-cutting section 50 with the coated sheet 30 which has been pulled out by the sheet pullout roller section 44 and passed between and shear-cut by the lower cutting blade 10 and upper cutting blade 20; and pass rolls 45A, 45B, 45C, which are arranged between the sheet pullout roller section 44 and the shear-cut sheet supply roller section 46 and serve to change the feed direction of the coated sheet 30 while properly maintaining the tension applied to the coated sheet 30. The position where the coated sheet 30 is passed through between the lower cutting blade 10 and upper cutting blade 20 and shear-cut thereby is located partway along the feed path segment between the pass roll 43D and the sheet pullout roller section 44.

The sheet pullout roller section 44 clamps the coated sheet 30 between two rotary rollers 44A and 44B, and unwinds the coated sheet 30 from the sheet roll 35 for feeding. The shear-cut sheet supply roller section 46 supplies the coated sheet 30 to the sheet cutting section 50 through the nip between two rollers 46A, 46B which are intermittently rotated such that the coated sheet 30 is cut in predetermined length at the sheet cutting section 50.

The feed section 40 mentioned above feeds the coated sheet 30 in the direction H perpendicular to the aforementioned rotational axis 1 through between the lower cutting blade 10 and the upper cutting blade 20, while maintaining the surface of the substrate 32 of the coated sheet 30 on a side opposite the coating layer 31 in contact with a periphery 12 of the lower cutting blade 10. The sheet cutting section 50 cuts the coated sheet 30 supplied through the shear-cut sheet supply roller section 46 in the direction perpendicular to the feed direction of the coated sheet 30.

In the following, a process for cutting a coated sheet 30 by means of the coated sheet cutting apparatus of the invention will be described in detail.

The coated sheet 30 is clamped between the two rollers 44A and 44B of the sheet pullout roller 44, and unwound from the sheet roll 35 for feeding. The coated sheet 30 is delivered via the pass rolls 42A to 43D and passed through the nip between the lower cutting blade 10 rotating under the drive of the lower-blade rotating motor 15 and the upper cutting blade 20 rotating under the drive of the upper-blade rotating motor 25, where the coated sheet 30 is cut by the rotating lower and upper cutting blade 10, 20 in the sheet feed direction (in the direction shown by arrow H in FIG. 1). In the coated sheet cutting apparatus of the second embodiment, when shear-cutting the coated sheet 30, a contact start position P1 where the coated sheet and the upper cutting blade 20 start contacting is disposed, as shown in FIG. 10, within a contacting area R1 where the coated sheet contacts with the periphery 12 of the lower cutting blade 10. Then, the coated sheet 30 is subjected to shear-cutting with the lower cutting blade 10 and the upper cutting blade partly overlapping one another.

Here, the contact area R1 is the area extending from a lower-blade contact start position E1, where the contacting between the lower cutting blade 10 and the coated sheet 30 starts, to a contact end position F1, where the contacting between the lower cutting blade 10 and the coated sheet 30 ends. The contact start position P1 is a most upstream position, along the foregoing feed direction within the area, where the coated sheet 30 contacts the upper cutting blade 20. The angle formed between a straight line, which extends through the rotational axis C1 of the lower cutting blade 10 and the lower-blade contact start position E1, and the coated sheet 30 extending toward upstream in the feed direction is substantially 90°, and the angle formed between another straight line, which extends through the rotational axis C1 mentioned above and the lower-blade contact end position F1, and the coated sheet 30, which extends toward downstream in the feed direction, is also substantially 90°.

The coated sheet 30, which has been shear-cut while being passed through between the aforementioned lower cutting blade 10 and upper cutting blade 20, is passed through the sheet pullout roller section 44, guided via the aforementioned pass rolls 45A to 45C, clamped between two feed rollers 46A, 46B of the shear-cut sheet supply roller section 46, and finally delivered to the sheet-cutting section 50. Thus, the sheet-cutting section 50 cuts the delivered coated sheet 30 in the direction perpendicular to the feed direction. Hereinafter, a description will be made on the relationship between the shear-cut quality and overlap amount when a coated sheet 30 is subjected to shear-cutting. FIG. 11 is a cross sectional view showing the dimensions of the upper and lower cutting blades and the detail of the positional relationship between these upper and lower cutting blades. In addition, FIG. 11 is a view in section similar to FIG. 10 seen looking along the direction similar to that of FIG. 10.

As shown in FIG. 11, in this particular embodiment, the outer diameter D1 of the lower cutting blade 10 is 110 mm, and the outer diameter D2 of the upper cutting blade 20 is 138 mm. Here, an overlap amount W refers to an overlap amount where a part of the lower cutting blade 10 and a part of the upper cutting blade partly overlap one another, that is, the width of overlap, between both blades on the line extending through the rotational axes C1 and C2 thereof, viewed looking along the direction of the rotational axes. Further, a position J is a most upstream position along the feed direction of the zone where the upper cutting blade 20 and lower cutting blade 10 overlap one another. A catch and cut-in angle β is an angle formed between a tangent line S1 of the lower cutting blade 10 at the position J and a tangent line S2 of the upper cutting blade 20 at the position J. More particularly, this catch and cut-in angle β is facing or opposed to a region G where the lower cutting blade 10 and the upper cutting blade partly overlap one another in the direction that the rotational axes extend. The catch and cut-in angle β varies from 10.4° to 20.7° depending on the change of the overlap amount W from 0.5 mm to 2 mm.

Table 2 shows the relationship among the overlap amount W, the catch and cut-in angle β, and the shear-cut quality.

TABLE 2

| overlap amount (W) | catch and cut-in angle (β) (deg.) | shear-cut quality crack | shear-cut quality flaw |
|---|---|---|---|
| 0.5 mm | 10.4° | E | E |
| 0.7 mm | 12.3° | E | E |
| 1.0 mm | 14.7° | E | E |
| 1.3 mm | 16.7° | G | E |

TABLE 2-continued

| overlap amount (W) | catch and cut-in angle (β) (deg.) | shear-cut quality crack | shear-cut quality flaw |
|---|---|---|---|
| 1.5 mm | 18.0° | G | G |
| 1.7 mm | 19.1° | NG | NG |
| 2.0 mm | 20.7° | NG | NG |

E: excellent, G: good, NG: not good

When the overlap amount W was 2.0 mm and 1.7 mm, that is, the catch and cut-in angle β was 20.7° and 19.1°, many cracks and flaws were formed in the coating sheet 31 by shear-cutting the coated sheet 30. Thus, the shear-cut quality is low as shown in Table 2, and the coated sheet after subjected to shear-cutting did not reach a level allowable as a product. That is, an amount of press-bending that the coated sheet undergoes during shear-cutting by the upper cutting blade increase and a part of the coated sheet is largely deformed, whereby a large stress is produced in the coating layer. As a result, a great number of cracks and flaws are produced in the coated sheet.

When the overlap amount W was 1.5 mm, that is, the catch and cut-in angle β was 18°, deterioration in quality was low though some cracks and flaws were produced as shown in Table 2. Thus, the coated sheet after subjected to shear-cutting had an acceptable level as a product. That is, an amount of press-bending that the coated sheet undergoes during shear-cutting by the upper cutting blade, and in turn a partial deformation of the coated sheet decrease, as a result of which a large stress that could cause cracks and flaws in the coated sheet is prevented.

When the overlap amount W was 1.3 mm, that is, the catch and cut-in angle β was 16.7°, flaws were eliminated though some cracks were found as shown in Table 1. Thus, the shear-cut quality was improved compared with the case that the overlap amount W was 1.5 mm.

When the overlap amount W was 1.0 mm, 0.7 mm, or 0.5 mm, that is, when the catch and cut-in angle β was 14.7, 12.3 or 10.4°, there were free of cracks and flaws and fairly good shear-cut quality was achieved as shown in FIG. 1.

While the foregoing embodiment uses a recording sheet for inkjet printing as a coated sheet, this invention is not limited thereto. Similar effects can also be obtained by any other coated sheets produced by layering a coating layer on a substrate which is, for example, a paper sheet, a film, or a resin coated sheet. The coating layer is filled with fine particles mainly composed of inorganic materials including calcium carbonate, hydrated alumina, and silica which are held together by a resin binder or the like.

Especially, for a coated sheet which is a gloss photo paper sheet for inkjet printing which has a nature that the connection between fine particles is easily broken by an external force such as bending, a remarkable effect for preventing deterioration of shear-cut quality as described above is achieved.

The shear cut quality undergoes a slight change if one or more shear-cutting conditions including the diameter of the upper cutting blade, the diameter of the lower cutting blade, and sheet federate are changed and if the thickness of the coated sheet and/or coating layer is changed. It was separately found that when the coated sheet is subjected to shear-cutting with the contact start position of the upper cutting and coated sheet being located in the contacting area where the coated sheet contacts with the periphery of the lower cutting blade, the aforementioned overlap amount is a principal factor of determining the shear-cut quality.

This test was conducted while varying the thickness of the coating layer from 0.01 mm to 0.1 mm and the thickness of the coated sheet including the thickness of the coating layer from 0.1 mm to 0.5 mm.

What is claimed is:

1. A method of cutting a coated sheet, comprising the steps of:

positioning a disk-shaped lower cutting blade and a disk-shaped upper cutting blade, which is disposed opposite the lower cutting blades and has a sharper knife angle compared with a knife angle of the lower cutting blade, such that rotational axes of the lower and upper cutting blades are arranged parallel to each other, and such that a part of the lower cutting blade and a part of the upper cutting blade overlap one another in the direction that the rotational axes extend;

feeding a coated sheet with a coating layer which is filled with fine particles mainly composed of inorganic materials which are held together by a resin binder, on one side between the upper and lower cutting blades in the direction perpendicular to the rotational axes with a surface of the coated sheet disposed on a side opposite the coating layer being maintained in contact and being curved along with a periphery section of the lower cutting blade while rotating the upper and lower cutting blades; and shear-cutting the coated sheet by the upper and lower cutting blades in the direction of feeding the coated sheet, the method further comprising the step of, when the coated sheet is subjected to shear-cutting, positioning a contact start position, where contact between the coated sheet and the upper cutting blade starts, in a region which is located upstream in the feed direction of the coated sheet but outside a contacting area in the coated sheet where the coated sheet contacts with the periphery of the lower cutting blade and the upper cutting blade starts cutting the coated sheets from the contact start position, and positioning a contact end position, where contact between the coated sheet and the upper cutting blade ends, in a region which is located downstream in the feed direction of the coated sheet but inside the contacting area in the coated sheet where the coated sheet contacts with the periphery of the lower cutting blade.

2. The method of cutting a coated sheet according to claim 1, wherein the coated sheet is a recording sheet for inkjet printing.

3. The method of cutting a coated sheet according to claim 1, wherein the coated sheet comprises a substrate and the coating layer comprises silica particles bound by a resin binder.

* * * * *